United States Patent [19]

Cremers

[11] Patent Number: 5,076,781

[45] Date of Patent: Dec. 31, 1991

[54] MODULATED GAS RADIATOR

[75] Inventor: Johannes H. M. Cremers, Oostrum, Netherlands

[73] Assignee: Fancom B.V., Panningen, Netherlands

[21] Appl. No.: 436,213

[22] Filed: Nov. 14, 1989

[30] Foreign Application Priority Data

Nov. 14, 1988 [NL] Netherlands ..... 8802791

[51] Int. Cl.[5] ..... F23N 5/00

[52] U.S. Cl. ..... 431/75; 431/2; 431/12; 126/91 A

[58] Field of Search ..... 431/75, 12, 2; 126/91 A

[56] References Cited

FOREIGN PATENT DOCUMENTS 2560359 8/1985 France ..... 126/91 A 161107 1/1983 Japan .

59-202318 11/1984 Japan .

*Primary Examiner*—Larry Jones

*Attorney, Agent, or Firm*—Weingarten, Schurgin, Gagnebin & Hayes

[57] ABSTRACT

A gas-fired heater, in particular of the type having radiant bodies (6) to be heated by gas flames, in which fuel gas and combustion air are supplied under pressure to at least one burner nozzle (19, 10) in a proportion ensuring complete combustion, and further comprising an air chamber (9) in association with the or each burner (20), and the chamber having an outlet terminating in the ambient space of sufficient dimensions to offer no essential resistance to air flowing out into the ambient. A venturi (10) extends from the chamber (9) into the burner (20). A gas supply nozzle (18) is arranged coaxially in front of the throat of the venturi (19) within the chamber (9). Means (3, 7, 8) are provided for supplying air to the chamber (9) in a quantity slightly in excess of that needed for complete combustion at maximum capacity of the burner (20).

5 Claims, 2 Drawing Sheets

MODULATED GAS RADIATOR

BACKGROUND OF THE INVENTION

This invention relates to a gas-fired heating apparatus, in particular a heating apparatus of the type having radiant bodies to be heated by gas flames, and in which fuel gas and combustion air are supplied under pressure to at least one burner nozzle in a proportion ensuring complete combustion, and further comprising an air chamber in association with said at least one burner, said chamber having an outlet terminating in the ambient space, a venturi extending from said chamber into the burner, and a gas supply nozzle disposed within the chamber coaxially in front of the venturi throat, as disclosed in JP-A-59 202318 (MATSUSHITA DENKI SANGYO K.K.).

An advantage of such an apparatus is that no polluted air is sucked in from the ambient space, which may give rise to fouling of burners.

In the prior apparatus, the air supply and gas supply are controlled in dependence upon measurements of the air pressure within the air chamber and the gas pressure within the gas supply conduit to the nozzle. When the type of gas is changed adjustment is effected with throttle means in the gas supply path and in the outlet to the outside air, the arrangement being such that the adjusted ratio has a constant value.

With the advent of new gas radiators, however, which can be operated through a large range of their capacity (e.g. from 3–100%) by controlling the gas supply pressure, the problem has been introduced that complex measures are required to maintain the correct gas/air ratio throughout the entire control range.

SUMMARY OF THE INVENTION

It is an object of the present invention to provide a gas-air-fired heater in which this drawback is avoided.

To this effect, according to the present invention, means are provided for supplying air to the chamber in a quantity slightly larger than needed for complete combustion when the burner is operated at maximum capacity, and further by said outlet being of sufficient dimensions to offer no essential resistance to air flowing out into the ambient.

The apparatus according to the invention operates as follows:

Owing to the combined effect of the effluent gas and the venturi, combustion air is sucked in at all times in a quantity sufficient for a complete combustion of the gas supplied. The air required is withdrawn from the chamber to which, however, the air is supplied in a slight excess. The excess can escape through the outlet.

When the gas pressure is reduced to lower the output of the burner, less air of combustion will be sucked in at the venturi inlet. The only result as far as the supply of air is concerned is that the excess of air within the chamber is increased and hence the amount of air which escapes through the chamber outlet is increased. The pressure prevailing within the chamber is not essentially changed and accordingly, the gas/air ratio is not essentially changed either.

Accordingly, in the apparatus according to the invention, the advantages of the prior apparatus, namely, clean air is supplied to the burner and there is a constant gas/air ratio, are maintained, and the disadvantage of the prior apparatus, namely, complex adjustment in the case of gas pressure fluctuations, is absent. In fact, according to the invention, owing to the relatively large outlet of the air chamber to the outside air, there is effected an automatic adaptation of the supply of air of combustion to the instantaneous gas rate, so that even when the gas pressure is greatly reduced, and accordingly the burner requires a much smaller quantity of air, no essential overpressure is created within the chamber, not even temporarily, because the outlet offers no essential resistance to air flowing out into the ambient atmosphere.

If, in the apparatus according to the invention, the supply of air to the chamber should fail, for any reason whatsoever, the outlet ensures that through this opening, as a result of the effect of the venturi, air can be drawn into the chamber from the ambient atmosphere, so that even in the case of such calamities, the burner does not fail.

In order that, in these conditions too, fouling of the burner may be effectively prevented, in a further elaboration of the invention the outlet is equipped with a relatively coarse (gauze) filter. During normal operation, this filter is not fouled, because it only needs to pass clean excess air of combustion. In the emergency outlined above, the filter retains dirt from the ambient atmosphere.

For supplying air to the chamber at a constant rate that can be adjusted to a quantity slightly larger than needed for complete combustion at maximum capacity, it is possible, according to the invention, to use an air pump arranged to deliver air under pressure to said chamber through an air conduit, and a pressure reducing means at the junction between said air conduit and said chamber.

A structurally simple pressure reducing means comprises an adjustable passage and a widening transition member to the chamber.

To change the gas supply pressure for changing the burner capacity, use can be made of a pressure regulator controlled by a motor.

BRIEF DESCRIPTION OF THE DRAWINGS

Some embodiments of the invention will now be described, by way of example, with reference to the accompanying drawings. In said drawings

DESCRIPTION OF THE PREFERRED EMBODIMENTS

Figure 1:
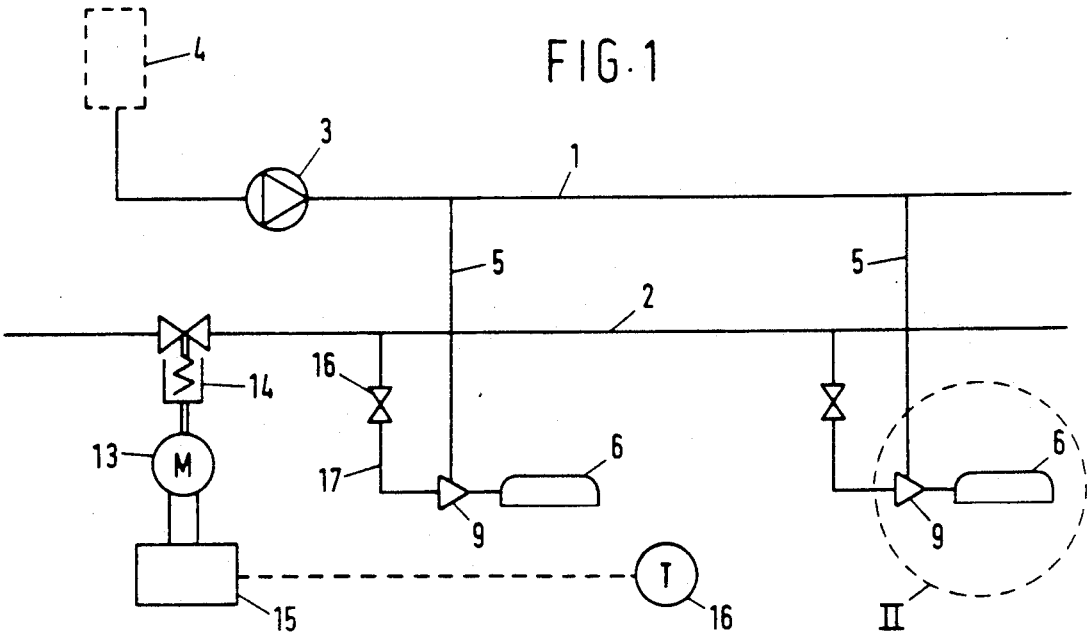
FIG. 1 is a diagram of a space heating apparatus incorporating gas burners formed as heat radiators.

According to FIG. 1, the apparatus comprises an air conduit 1 and a gas conduit 2. Clean air is pumped into the air conduit by an air pump, which air is drawn in through an air filter 4, so that a substantially constant overpressure prevails within the air conduit.

Branch lines, for example, in the form of flexible tubes 5, extend from the air conduit 1 to heat radiators 6 distributed over the space to be heated.

Figure 2:
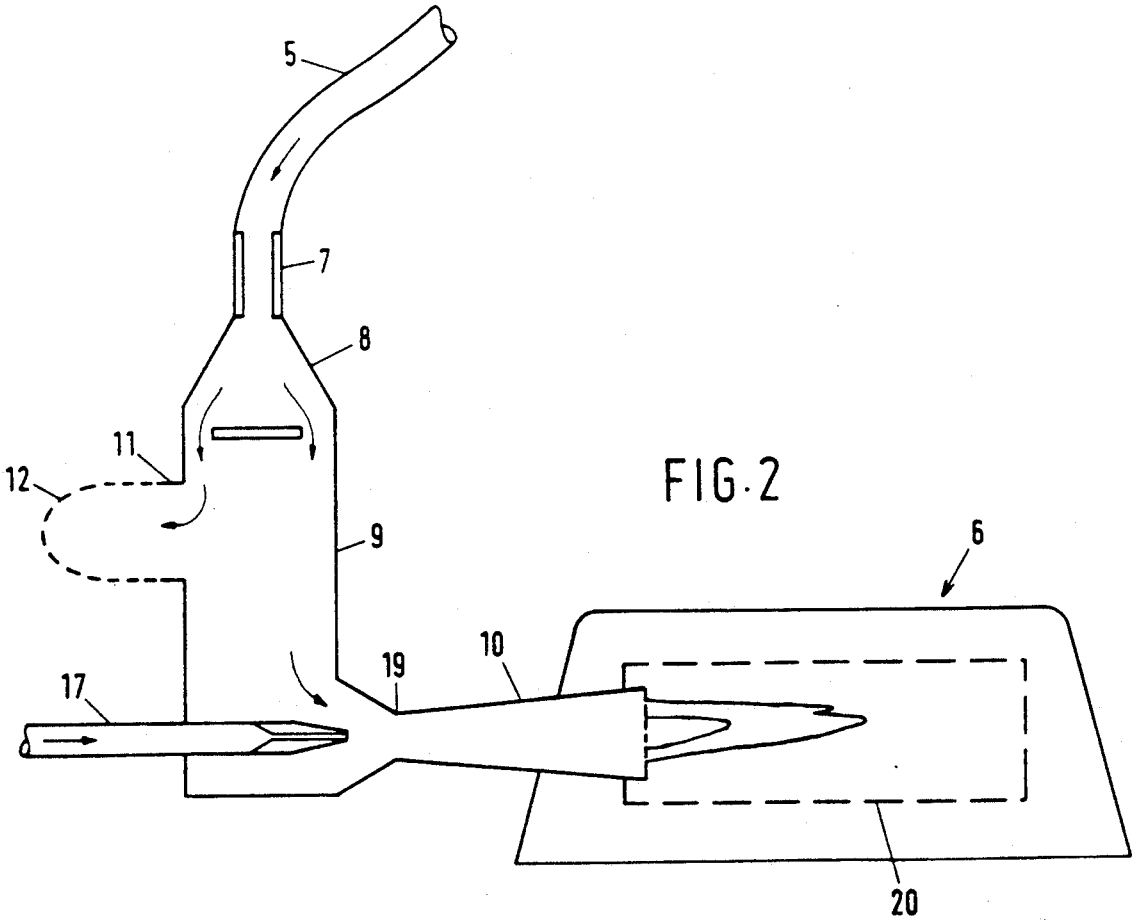
FIG. 2 shows the detail encircled in FIG. 1, and designated by II.

As shown in FIG. 2, tube 5 is connected to radiator 6 through a controllable or calibrated passage 7, a reducing member 8, a chamber 9, and a venturi 10. Chamber 9 is provided with an outlet 11 with a gauze filter 12.

The gas conduit 2 is fed through a pressure control valve 14 operated by a motor 13 and controlled by a regulator 15, which may be equipped with a temperature sensor. Branching from gas conduit 2 are gas supply lines 17, equipped with valves 16, to the respective chambers 9. Each gas supply line 17 terminates coaxially with the venturi 10 in a nozzle 18 located in front of throat 19 of the venturi.

The venturi terminates in a burner which is in the form shown is an incandescent body 20 functioning as a heat radiator.

In operation, gas is blown at a variable pressure from nozzle 18 into the throat 19 of venturi 10. Owing to the impulse of the effluent gas and the subatmospheric pressure created in the venturi, air is at all times drawn from chamber 9 in a quantity sufficient for a complete combustion of the gas supplied. Pump 3 supplies so much air that in each chamber 9 the supply of air is at all times slightly greater than needed for complete combustion of the gas supplied when the burner is operated under full-load conditions. The excess of air escapes through the outlet 11 into the ambient atmosphere. As the air pressure prevailing within chamber 9 must not essentially fluctuate, which in fact would affect the gas/air ratio in burner 20, the outlet is dimensioned so that it offers no significant resistance to escaping air.

As the air of combustion supplied to the chamber is at least sufficient for the maximum burner capacity, the excess is increased as the gas pressure at nozzle 18 decreases. According as the burner is set at a lower output, therefore, more air flows to the outside through outlet 11.

The apparatus according to the invention offers additional safeguard against calamities, for example, failure of the air pump 3 and/or complete clogging of the air filter 4. In such cases, insufficient air, or none at all, is supplied through tube 5. Nevertheless, sufficient air can be drawn in through outlet 11. The gauze filter 12 then prevents the ingress of dirt. In order that, during normal operation, filter 12 should offer minimal resistance to effluent excess air, a relatively coarse gauze is selected for the filter 12.

The apparatus according to the invention enlarges the applicability of gas-fired heat radiators, especially in polluted environments, without complex and expensive constructions being required.

Figure 3:
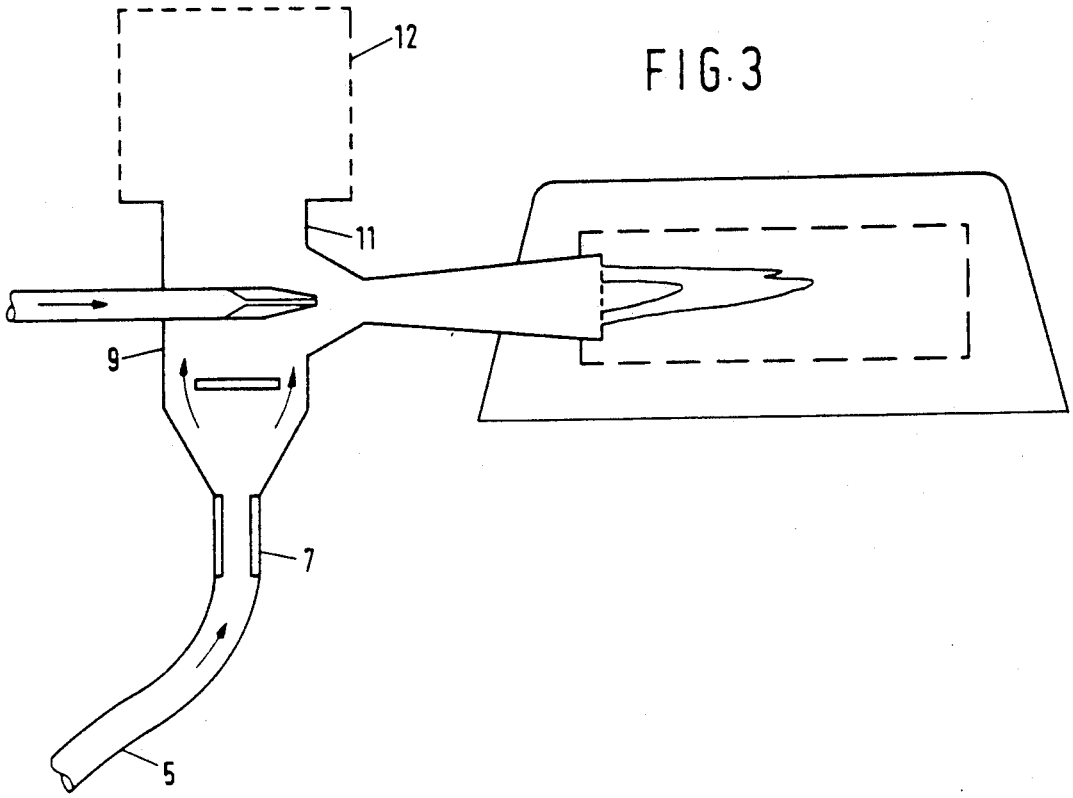
FIGS. 3 and 4 show variant embodiments of the detail of FIG. 2.
Figure 4:
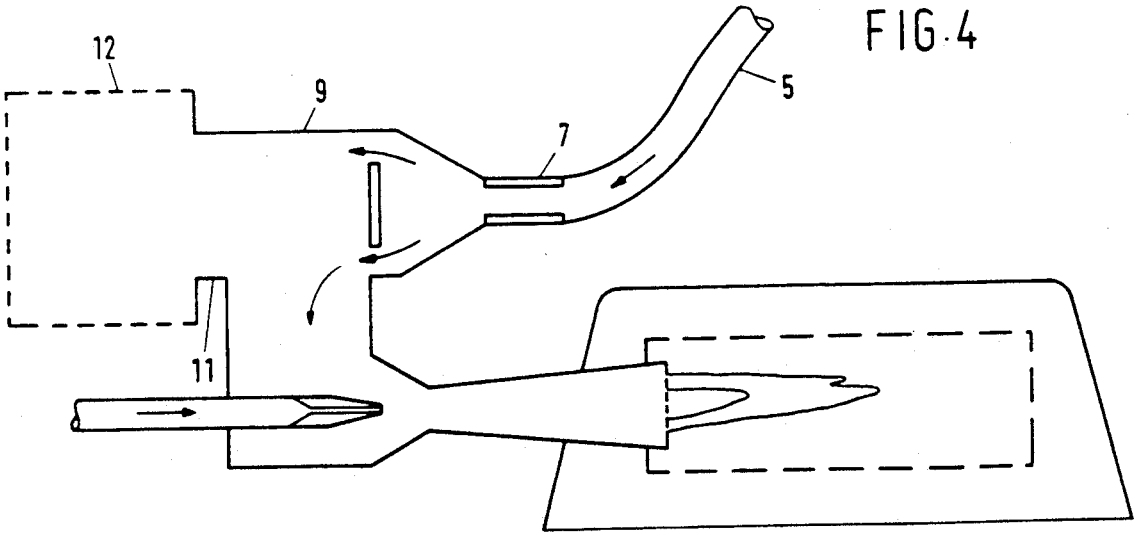

FIGS. 3 and 4 illustrate other embodiments of chamber 9 in which the positions of air passage 7 and outlet 11 are diametrically opposite.

I claim:

1. Gas-fired heating apparatus, in particular a heating apparatus of the type having radiant bodies to be heated by gas flames, and in which fuel gas and combustion air are supplied under pressure to at least one burner nozzle in a proportion ensuring complete combustion, and further comprising an air chamber in association with said at least one burner said chamber having an outlet terminating in the ambient space, a venturi extending from said chamber into the burner, and a gas supply nozzle disposed within the chamber coaxially in front of the venturi throat, characterized by means (3,7,8) for supplying air to the chamber (9) in a quantity slightly larger than needed for complete combustion when the burner is operated at maximum capacity, and further by said outlet (11) being of sufficient dimensions of offer no essential resistance to air flowing out into the ambient, said venturi and said fuel gas coacting to produce a self-regulating supply of air in a quantity sufficient to result in the complete combustion of the fuel gas supplied.

2. A heater as claimed in claim 1, characterized in that said outlet (11) is equipped with a relatively coarse (gauze) filter (12).

3. A heater as claimed in claim 1, characterized in that use is made of an air pump (3) arranged to deliver air under pressure to aid chamber (9) through an air conduit (5), and a pressure reducing means (7, 8) at the junction between said air conduit (5) and said chamber (9), whereby air may be supplied to said chamber (9) at a constant rate that can be adjusted to a quantity slightly in excess of that needed for complete combustion at maximum capacity.

4. A heater as claimed in claim 3, characterized in that said pressure reducing means comprises an adjustable passage (7) and a widening transition member (8) to the chamber (9).

5. A heater as claimed in claim 1, characterized by the use of a pressure regulator (14) controlled by a motor (13).

* * * * *

UNITED STATES PATENT AND TRADEMARK OFFICE

CERTIFICATE OF CORRECTION

PATENT NO. : 5,076,781

DATED : December 31, 1991

INVENTOR(S) : Johannes H.M. Cremers

It is certified that error appears in the above-identified patent and that said Letters Patent is hereby corrected as shown below:

Column 4, line 19, "dimensions of offer" should read --dimensions to offer--.

Column 4, line 30, "to aid chamber" should read --to said chamber--.

Signed and Sealed this

Twentieth Day of July, 1993

*Attest:*

Michael K. Kirk

MICHAEL K. KIRK

*Attesting Officer*

*Acting Commissioner of Patents and Trademarks*